United States Patent [19]

Neitz et al.

[11] Patent Number: 4,584,971

[45] Date of Patent: Apr. 29, 1986

[54] EVAPORATIVE COOLING SYSTEM FOR INTERNAL COMBUSTION ENGINES

[75] Inventors: Alfred Neitz, Wendelstein; Wolfgang Held, Schnabelwaid, both of Fed. Rep. of Germany

[73] Assignee: Maschinenfabrik Augsburg-Nurnberg, Oberhausen, Fed. Rep. of Germany

[21] Appl. No.: 662,262

[22] Filed: Oct. 18, 1984

[30] Foreign Application Priority Data

Nov. 3, 1983 [DE] Fed. Rep. of Germany ..... 3339717

[51] Int. Cl.[4] ..... F01P 3/22

[52] U.S. Cl. ..... 123/41.21; 123/41.27; 123/41.54

[58] Field of Search ..... 123/41.2, 41.21, 41.23, 123/41.24, 41.25, 41.26, 41.27, 41.5, 41.54, 41.28

[56] References Cited

U.S. PATENT DOCUMENTS

| | | | |
|---|---|---|---|
| 1,213,273 | 1/1917 | Saunders | 123/41.2 |
| 1,355,069 | 10/1920 | Wendling | 123/41.2 |
| 1,680,567 | 8/1928 | Pitzman | 123/41.28 |
| 1,852,770 | 4/1932 | Duesenberg | 123/41.27 |
| 3,076,479 | 2/1963 | Ottung | 123/41.5 |
| 3,168,080 | 2/1965 | Latterner et al. | 123/41.26 |

FOREIGN PATENT DOCUMENTS

| | | | |
|---|---|---|---|
| 46808 | 1/1933 | Denmark | 123/41.2 |

*Primary Examiner*—William A. Cuchlinski, Jr.
*Attorney, Agent, or Firm*—Felfe & Lynch

[57] ABSTRACT

An evaporative cooling system for internal combustion engines for protecting such a cooling system against exhaust steam losses and corrosion and, furthermore, to adapt this system to the use in internal combustion engines of a relatively great length (such as for commercial vehicles or contractors' machinery—irrespective of any inclined positions which these vehicles assume). The system includes a flexible bladder provided in the surge tank which contacts the inner surfaces of the tank in the cold condition and the cooling jacket of the internal combustion engine is subdivided into several units in each of which a desired coolant level is maintained by appropriate control elements.

9 Claims, 4 Drawing Figures

Figure 1:
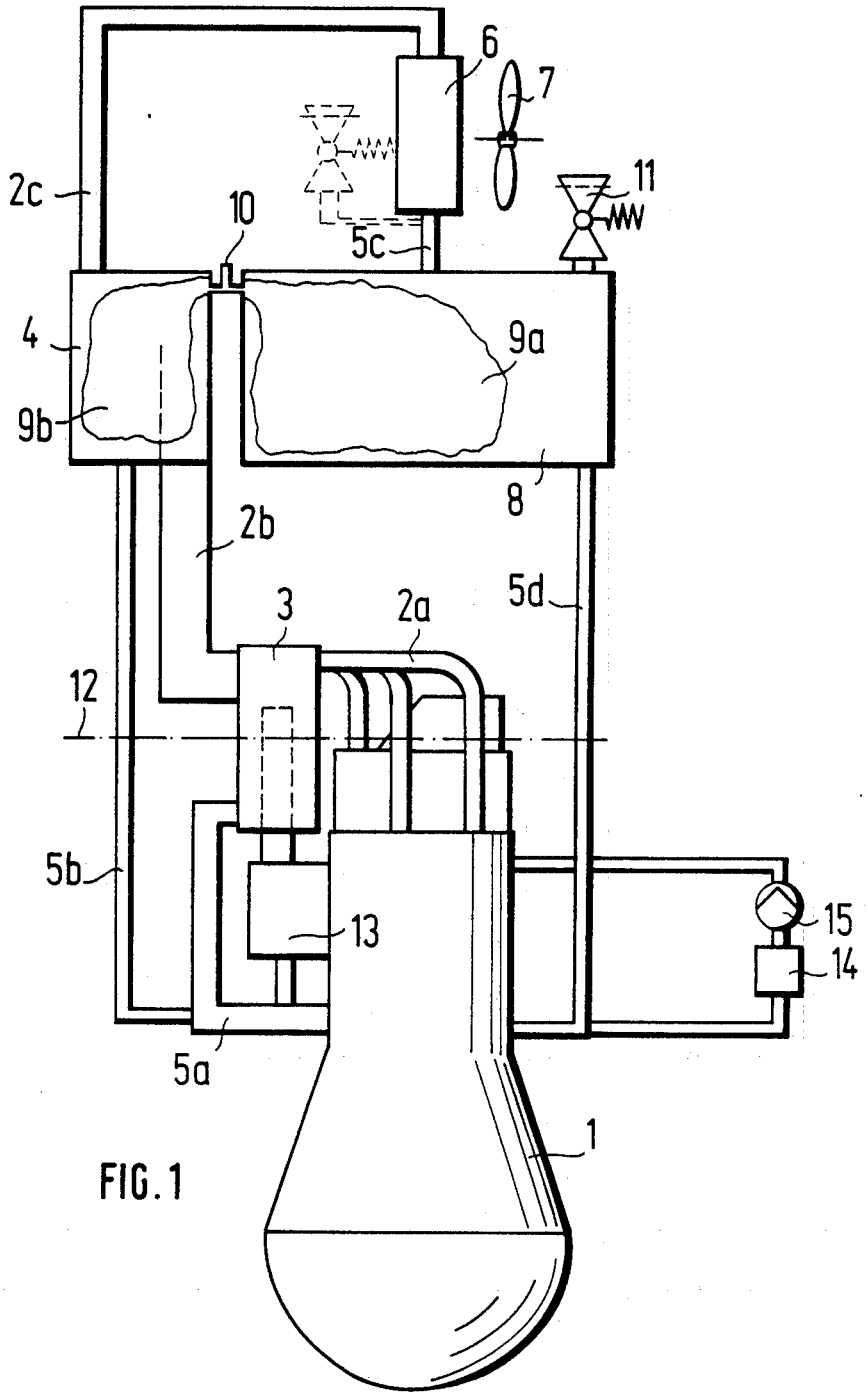

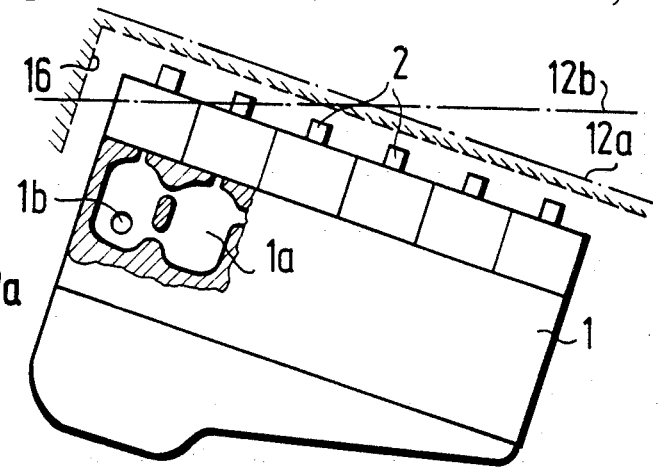
FIG. 2a
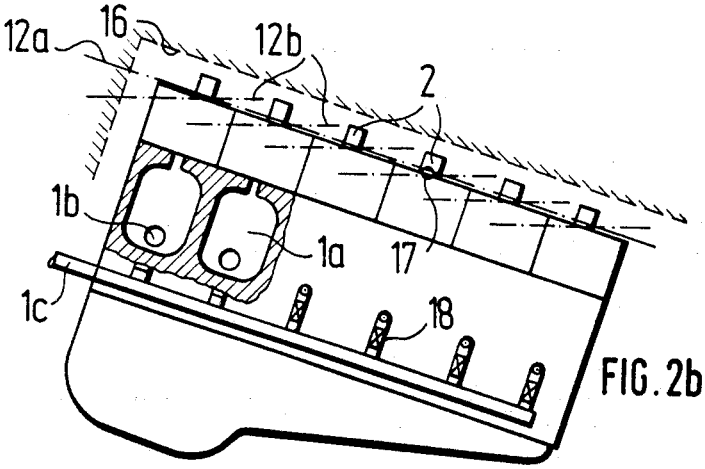
FIG. 2b
FIG. 3
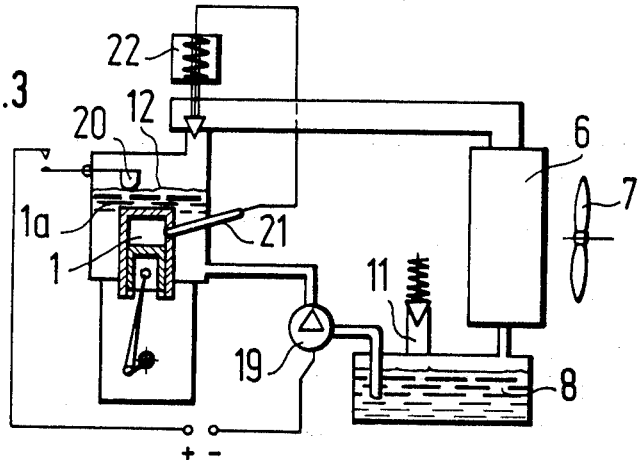

EVAPORATIVE COOLING SYSTEM FOR INTERNAL COMBUSTION ENGINES

This invention relates to a cooling system for an internal combustion engine in which cooling of a coolant is effected by evaporation and in which the vapours are subsequently re-liquified by the removal of heat in a cooling device (condenser), a surge vessel or tank being connected downstream of the condenser in which surge tank there is a flexible bladder or pouch which communicates with the atmosphere.

The use of the boiling phase of a coolant for heat dissipation, the heat of evaporation of a coolant being removed from the components to be cooled, such as the cylinder surfaces, the valves etc. of an internal combustion engine has been known for a long time. This type of cooling generally tends to equalize the component temperatures because boiling and, consequently, heat removal, takes place only at the points where the working cycle causes high heat release rates at the side of the combustion chamber.

In a typical evaporative cooling system for internal combustion engines, the coolant evaporates inside the cooling jacket of the internal combustion engine. Via the steam exhaust in the upper region of the cooling jacket, the steam passes through pipes and, for instance, a coolant droplet separator, to the radiator where the steam is condensed by the air-stream of the moving vehicle or a cooling fan. From the condensate collecting tank, the condensate is either returned by gravity (where the condenser is arranged above the cooling jacket) or by means of a pump (where the condenser is arranged at the level of or below the cooling jacket) to the cooling jacket of the engine—preferably at a lower level.

In order to avoid high coolant losses during operation, a sealed cooling system is generally adopted, any high pressures developing in the system being controlled by a combination overpressure/underpressure valve. However, coolant losses are not entirely avoided. In addition, rapid aging of the coolant takes place due to the fact that fresh oxygen-rich air penetrates into the system during every cooling cycle through the underpressure valve whereby the effectiveness of the rust inhibitors provided in the cooling system tends to be reduced more rapidly. These drawbacks are irreconcilable with a modern cooling system which is expected to be maintenance-free for a long period of time.

In contrast to liquid cooling systems, evaporative cooling systems have the cooling circuit not filled completely with coolant. As a result, cooling trouble is liable to be encountered when the engine is in an inclined position, in particular in vehicles having a long engine length (for example, commercial vehicles).

This invention has for an object to completely avoid cooling losses in an evaporative cooling system of the type initially referred to and to maintain the long-time effectiveness of the rust inhibitors contained in the coolant by preventing the ingress of oxygen from the atmosphere. Moreover, this special cooling system is intended to lend itself for vehicles with long engine lengths which have to negotiate gradients of 30% and more with full power, i.e. to ensure that positive cooling is ensured in such engines even on such extremely steep slopes at all times and to prevent any overheating due to the absence of cooling.

This object is achieved in that, in the cooled-down state of the internal combustion, the flexible bladder contacts the interior surfaces of the surge tank and in that the cooling jacket of the internal combustion engine is subdivided into several units in each of which an appropriate control element maintains a predetermined desired coolant level.

This feature enables the air contained in the cooling system above the cooling jacket of the internal combustion engine in the connecting pipes as well as in the condenser which is displaced during operation by the steam generated to be stored. As a result, neither overpressure nor underpressure can develop in the system. Since the actual cooling system has no connection to atmosphere, there are neither any coolant losses nor does premature aging of the rust inhibitors occur. By subdividing the cooling jacket into several units, typically according to the number of cylinders, fluctuations of the coolant level referred to the middle of the cylinder are approximately nil, practically independent of the route travelled—uphill, downhill or on the level. On the other hand, this means that the coolant level can be kept much lower whereby the total volume of the system is reduced.

True, the generic evaporative cooling system (U.S. Pat. No. 3,168,080) disclosed an arrangement where a surge tank is arranged downstream of the condenser in which surge tank there is provided a flexible bladder which communicates with the atmosphere. However, the surge tank also features a vent device fitted with a valve and, during operation, serves to collect and store the coolant which ultimately is returned via the condenser to the internal combustion engine. The vent valve referred to (provided on the so-called coolant reservoir) is controlled as a function of the coolant level in this tank and, at standstill of the engine and during operation, is open until a certain coolant level is attained in the reservoir. The object defined of this invention cannot be achieved by the state of the art disclosed because, on the one hand, oxygen-rich air penetrates into the cooling system and, secondly "coolant condensate sealing" prevailing in the upper part of the condenser or coolant reservoir prevents or, at least, impedes displacement of the air volume existing in the system into the coolant reservoir vessel provided. As a consequence, a larger condenser has to be used. Apart from this, the state of the art does not include any means of improving the climbing ability of the vehicle.

In terms of the present invention, the tank connected downstream of the condenser acts as a straight expansion vessel. The tank is not required to perform any storage function for the liquid coolant because the coolant is returned to the cooling jacket of the internal combustion engine on a different route.

It is advantageous to provide one or several coolant droplet separators between the cooling jacket of the internal combustion engine and the condenser. In order to reduce the size of the surge tank, it is proposed as a further development of the present invention to provide another flexible bladder at least in the last coolant droplet separator arranged downstream of the condenser.

As a further embodiment of the invention, it is proposed to provide a suitable relief valve as a safety valve on the cold side of the condenser. This is set at an absolute pressure of at least 1.1 bar and is arranged either on the surge tank or in the connecting pipe between the condenser and the surge tank which then has to be designed with an appropriate volume. Such a valve makes it possible to positively remove any combustion gases entering the circuit (on attaining the preset opening pressure). Since this valve is located on the cold side of the condenser, there will be no coolant losses.

The safety valve mentioned is not comparable with the vent valve in the U.S. patent referred to because the latter is controlled as a function of the coolant level in the coolant reservoir so that a safety function is not provided and an uncontrolled rise of the pressure in the cooling system is a possibility if any leakage of combustion gases occurs (with the vent valve closed).

The desired coolant level in individual cooling jacket units is monitored by suitable transmitters which mechanically, pneumatically or electrically act on the valves provided in the condensate inlets of the individual cooling units.

As an advantageous further development of the invention, it is proposed to increase the evaporation space pressure at part load operation of the internal combustion engine (inside the cooling jacket of the engine) above atmosphere. As a result, the well-known increase of the boiling temperature of the coolant is obtained. Due to the increase in the evaporation pressure, there is an increase in the component temperatures of the working space, e.g. the cylinder sliding surfaces, cylinder head deck, valves etc. As a result, these are maintained at approximately the same level (this term including at the same level) as at maximum output in part-load operation. This improves mixture formation and combustion and also fuel economy and exhaust gas quality. Control of the steam pressure between atmospheric pressure and an upper limit is as a function of a representative component temperature, for instance, of the cylinder working face temperature, via a steam pressure controller.

The component temperature is a function of the engine load represented by speed and load signals or as a function of the exhaust gas temperature. In order to prevent the upper pressure limit being exceeded, there may be provided a safety valve independent of the load or temperature-sensitive control, which safety valve may be integrated in the steam pressure controller.

In accordance with the invention, a cooling system for an internal combustion engine in which cooling is effected by evaporation of a coolant comprising cooling means in which the vapour or steam is subsequently reliquefied by the removal of heat. The cooling system also includes a surge tank connected downstream of the cooling means and provided with a flexible bladder therein which communicates with the atmosphere. The flexible bladder contacts the inner surfaces of the surge tank in the cooled-down condition of the internal combustion engine, the internal combustion engine having a cooling jacket sub-divided into several units. The cooling system also includes control means for maintaining approximately a desired coolant level in each cooling unit at substantially all times.

For a better understanding of the present invention, together with other and further objects thereof, reference is made to the following description, taken in connection with the accompanying drawings, and its scope will be pointed out in the appended claims.

Referring now to the drawings:

FIG. 1 is a diagram of the evaporative cooling system in accordance with the invention;

FIGS. *2a* and *2b* schematically show the variations of the coolant level in a multi-cylinder internal combustion engine for vehicles when operating on a gradient or on the level, FIG. *2a* showing the engine with a non-divided cooling jacket and FIG. *2b* showing it with a sub-divided cooling jacket;

FIG. 3 also is a schematic diagram of the evaporative cooling circuit during part-load operation of the internal combustion engine.

The numeral 1 in FIG. 1 designates the internal combustion engine. This is formed with a cooling jacket 1*a* (compare FIGS. *2a*, *2b* and 3) in which is contained a coolant suitable for evaporative cooling. The coolant is filled up to a predetermined level (coolant level 12).

The vapor or steam developing during operation (which primarily is produced at the thermally highly stressed components, such as the valve bridge, exhaust port and the upper liner portion) is passed through the exhaust steam pipe 2*a* to the first coolant droplet separator 3 where it is collected. After a part of the coolant entrained has been separated through the pipe 5*a*, the steam passes through the pipe 2*b* to the second coolant droplet separator 4. There, the flow velocity is reduced by a local increase in the cross-sectional area and additional coolant is separated which is returned through the return pipe 5*b* to the cooling jacket of the internal combustion engine 1. A pipe 2*c* passes the steam to one or distributes it between several condensers 6 in which the steam is re-liquified with the aid of fan 7. The coolant condensate is then delivered through the pipe 5*c* to the surge tank 8 and from there via pipe 5*d* to the cooling jacket 1*a* of the internal combustion engine 1.

In the cold condition, the whole space above the coolant level 12, which is roughly equivalent to the cylinder head top level, is filled with air; at rated output (full load), however, it is completely filled with steam. This means that the air which previously occupied the space has to be stored at some point. This is taken care of by the surge tank 8. In view of the requirement that operation should be pressureless with a sealed cooling circuit (this means that there must be no direct contact between the coolant and the ambient air), a plastic bladder 9*a* made of, for example, temperature-resistant, highly flexible polyurethane film or foil preferably is inserted in the surge tank 8, said bladder being screwed to the cover of the surge tank 8 so as to seal the cooling system to atmosphere. The bladder itself at opening 10 communicates with the atmosphere. In the cold condition, the bladder is filled with air, in other words, it contacts the inner walls of the surge tank; when the engine is hot, it is practically empty.

The second coolant droplet separator 4 is also fitted with a bladder because otherwise this volume would also have to be accommodated in the surge tank. This makes it possible to use a surge tank of smaller size.

To fill the cooling system, the atmospheric side of the flexible bladder 9*a* is subjected to a slight overpressure (about 50 mbar) which causes it to contact the inner surface of the surge tank on the coolant side. After sealing the cooling system, the pressure is equalized. This ensures that the complete surge tank volume is available to accept the air existing in the system. In the case of the second coolant droplet separator 4, a similar arrangement is adopted. The purpose of the bladder diaphragm in this case consists in minimizing the air volume in the system as far as possible.

For safety reasons, a relief valve 11 is provided on the surge tank 8.

Furthermore, FIG. 1 shows the heating circuit for a cab heating system. This includes a heating heat exchanger 14 as well as a heat pump 15. An oil cooler 13 is shown to indicate the cooling circuit for the lubricating oil.

FIG. 2*a* shows the coolant fluctuations with a non-divided cooling jacket and FIG. 2*b* shows the cooling fluctuations with a sub-divided cooling jacket. Subdividing the cooling jacket preferably is done in the case of multicylinder internal combustion engines, especially where as in the case illustrated individual cylinder heads are used. This makes it possible, in extreme cases, to provide individual cylinder cooling when it is quite possible to use a common steam and condensate circuit. It would also be conceivable to subdivide the complete cooling system into several separate steam and condensate circuits.

FIGS. 2*a* and 2*b* are schematic diagrams of a six cylinder internal combustion engine 1 which is arranged under a driver's cab 16. The coolant level on the level is designated 12*a* and that on a gradient 12*b*. The cooling jacket 1*a* of the internal combustion engine is shown partly sectioned in the FIG. 2*a* embodiment, the coolant may, for example, be fed to the cooling jacket 1*a* through a single port 1*b* only (on the first cylinder) and then distributed between the other cylinders. As can be seen, this tends to produce overheating problems in the cylinders which are at the highest level on a gradient, which last but not least, is due to the clearly longer engine length compared to private car engines. Another reason is the low silhouette of the engine unit generally called for.

In the embodiment of FIG. 2*b*, the cooling jacket 1*a* is subdivided according to the number of cylinders. Each cooling unit is formed with a coolant inlet port 1*b*. To prevent a mean coolant level resulting over the engine length with such a sub-divided cooling jacket, it is necessary to provide a suitable control element at each inlet port 1*b* of the individual cooling jacket unit. This is arranged so that a sensor or transmitter 17 is provided at the desired coolant level 12*a* in each cooling unit which causes a valve 18 arranged at the inlet of each cooling unit to be opened or closed mechanically, pneumatically or electrically. The individual inlets are branched off a common condensate inlet 1*c*. This enables the same results to be achieved with less complexity than where a complete steam and condensate circuit is provided for each cooling unit and there are almost no coolant fluctuations as the vehicle negotiates uneven ground.

FIG. 3 shows an evaporative cooling circuit where control of the evaporation pressure is provided during part-load operation of the internal combustion engine in order to achieve an improved combustion efficiency by means of control of the combustion chamber side component temperatures. This can be effected in a simple manner by varying the steam exhaust area. By increasing the evaporation pressure inside the cooling jacket 1*a*, the well-known increase of the boiling temperature of the coolant occurs whereby an increase in the wall temperatures of the working space results. As a result, the working-space side component temperatures, e.g. the cylinder sliding surfaces and also the oil temperature (bearings, cylinder lubrication, piston cooling) in the part-load range are kept at the same or approximately the same level as at maximum output.

Control of the steam pressure is as a function of the temperature of a representative component (for example, the cylinder sliding surface in the illustration) by means of the temperature sensor 21 which activates a pressure controller 22 for controlling the steam pressure obtained between atmospheric pressure and an upper limit. Furthermore, this figure also shows a float valve 20 which controls a condensate pump 19.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A cooling system for an internal combustion engine in which cooling is effected by evaporation of a coolant comprising:

cooling means in which the vapor or steam is subsequently reliquified by the removal of heat;

a surge tank connected downstream of said cooling means and provided with a flexible bladder therein which communicates with the atmosphere;

the flexible bladder contacting the inner surfaces of the surge tank in the cooled-down condition of the internal combustion engine, the internal combustion engine having a cooling jacket sub-divided into several units;

the cooling system also including control means for maintaining approximately a desired coolant level in each cooling unit at substantially all times.

2. A cooling system in accordance with claim 1, in which the cooling means comprises a condenser and one or more coolant droplet separators between the cooling jacket of the internal combustion engine and the condenser, and which includes a flexible bladder at least in one coolant droplet separator arranged upstream of the condenser.

3. A cooling system in accordance with claim 1, which includes a relief valve provided as a safety valve on the cold side of the condenser.

4. A cooling system in accordance with claim 3, which includes a connecting pipe between the condenser and the surge tank and in which the safety valve is located in the connecting pipe.

5. A cooling system in accordance with claim 3, in which the safety valve is located on the surge tank.

6. A cooling system in accordance with claim 3, in which the safety valve is set for an absolute pressure of at least 1.1 bar.

7. A cooling system in accordance with claim 1, which includes a plurality of cooling units having condensate inlets and in which a sensor is provided at the level of the desired coolant level in each cooling unit and in which each cooling unit has a condensate inlet and a valve at said condensate inlet, said sensor causing said valve at said condensate inlet of each cooling unit to be opened or closed.

8. A cooling system in accordance with claim 1, which includes means for controlling the steam pressure during part-load operation of the internal combustion engine inside the cooling jacket of the internal combustion engine as a function of a representative component temperature.

9. A cooling system in accordance with claim 8, in which said steam pressure partially controlling means includes a temperature sensor and a pressure controller which is activated by the temperature sensor for controlling the steam pressure obtained between atmospheric pressure and an upper limit.

* * * * *